US006286813B1

(12) United States Patent
Coccaro

(10) Patent No.: US 6,286,813 B1
(45) Date of Patent: Sep. 11, 2001

(54) AUTOMOTIVE JACK EMPLOYING A PNEUMATIC LIFTING SYSTEM

(76) Inventor: Albert V. Coccaro, 9 Capricorn La., Mt. Kisco, NY (US) 10549

( * ) Notice: Subject to any disclaimer, the term of this patent is extended or adjusted under 35 U.S.C. 154(b) by 0 days.

(21) Appl. No.: 08/985,573

(22) Filed: Dec. 5, 1997

(51) Int. Cl.[7] ..... B66F 3/24
(52) U.S. Cl. ..... 254/93 HP
(58) Field of Search ..... 254/93 H, 93 HP, 254/8 B, 1, 133, 134, 109

(56) References Cited

U.S. PATENT DOCUMENTS

| | | | | |
|---|---|---|---|---|
| 1,344,037 | * | 6/1920 | Heymann | 254/93 HP |
| 2,805,839 | * | 9/1957 | Branick | 254/93 HP |
| 2,852,229 | | 9/1958 | Gross . | |
| 3,695,582 | | 10/1972 | Clay . | |
| 3,730,366 | | 5/1973 | Berends . | |
| 3,982,731 | | 9/1976 | Tezuka . | |
| 3,994,474 | | 11/1976 | Finkbeiner . | |
| 4,203,578 | * | 5/1980 | Margueratt | 254/109 |
| 4,275,869 | | 6/1981 | Clements . | |
| 4,295,635 | | 10/1981 | Pustka et al. . | |
| 4,323,141 | | 4/1982 | Ragan et al. . | |
| 4,462,569 | * | 7/1984 | Arzouman | 254/8 B |
| 4,542,882 | | 9/1985 | Choe . | |
| 4,560,145 | | 12/1985 | Widmer . | |
| 4,605,203 | | 8/1986 | Hooper et al. . | |
| 4,678,164 | | 7/1987 | Yang . | |
| 4,688,760 | | 8/1987 | Garman et al. . | |
| 4,771,221 | | 9/1988 | Finkbeiner . | |
| 4,786,032 | | 11/1988 | Garman et al. . | |
| 4,817,412 | | 4/1989 | Hinson . | |
| 4,913,402 | | 4/1990 | McJunkin, Jr. . | |
| 4,938,305 | | 7/1990 | Park . | |
| 5,181,693 | | 1/1993 | Lorenz . | |
| 5,184,930 | | 2/1993 | Kuhn . | |
| 5,419,534 | | 5/1995 | Vesely . | |
| 5,446,938 | | 9/1995 | Warner et al. . | |
| 5,506,012 | | 4/1996 | Wright et al. . | |
| 5,542,806 | | 8/1996 | Kang . | |
| 5,651,155 | | 7/1997 | Hodges et al. . | |

FOREIGN PATENT DOCUMENTS

| | | |
|---|---|---|
| 2746610 | 4/1978 | (DE) . |
| 0017765 | 10/1980 | (EP) . |
| 0064673 | 11/1982 | (EP) . |
| 2091905 | 1/1971 | (FR) . |
| 2044843 | 2/1971 | (FR) . |

* cited by examiner

*Primary Examiner*—Robert C. Watson
(74) *Attorney, Agent, or Firm*—Clifford L. Tager

(57) ABSTRACT

The present invention is directed to a jack preferably comprising: a platform; a jack arm stabilizer guide having a first and a second terminal end, the first terminal end being attached to the platform; a jack arm; a jack arm stabilizer attached near the first terminal end of the jack arm, and the jack arm stabilizer is preferably slidably connected to the jack arm stabilizer guide so as to allow the jack arm stabilizer to be translocatable between the first and the second terminal ends of the jack arm stabilizer guide; and a vertical lift system operatively connected between the jack arm and the platform which is capable of vertically lifting the jack arm, thus translocating the jack arm stabilizer within the jack arm stabilizer guide. The vertical lift system preferably comprises a bellow connected between the platform and the jack arm, wherein the bellow is capable of being inflated causing it to vertically expand, thereby lifting the jack arm and translocating the jack arm stabilizer between the first and the second terminal ends of the jack arm stabilizer guide. The jack preferably further comprises a lock and release system to prevent the jack arm from descending subsequent to the jack arm having been lifted by the vertical lift system.

32 Claims, 7 Drawing Sheets

AUTOMOTIVE JACK EMPLOYING A PNEUMATIC LIFTING SYSTEM

BACKGROUND OF THE INVENTION

Technical Field

The present invention is directed to device for lifting heavy objects, commonly known as a jack. More particularly, the present invention is directed to a jack which employs a pneumatic system for lifting.

The present invention finds particular utility in the field of automotive repair.

SUMMARY OF THE INVENTION

The present invention is directed to a jack preferably comprising a platform, a jack arm stabilizer guide having a first and a second terminal end, the first terminal end being attached to the platform, and a jack arm.

The jack arm stabilizer is attached near the first terminal end of the jack arm, and the jack arm stabilizer is preferably slidably connected to the jack arm stabilizer guide so as to allow the jack arm stabilizer to be translocatable between the first and the second terminal ends of the jack arm stabilizer guide.

The jack further comprises a vertical lift system operatively connected between the jack arm and the platform which is capable of vertically lifting the jack arm, thus translocating the jack arm stabilizer within the jack arm stabilizer guide The jack arm stabilizer guide preferably comprises a first arm having a first and a second terminal end, the first terminal end of the first arm being attached to the platform. A race is preferably located within the first arm. The jack arm stabilizer guide further comprises a second arm having a first and a second terminal end, wherein the first terminal end of the second arm is attached to the platform. A race is also located within the second arm. Preferably, the first arm and the second arm are attached to the platform such that the race located within the first arm is diametrically opposed to the race located within tile second arm.

The jack arm stabilizer preferably comprises a first plate and a second plate diametrically opposed thereto. A first set of bearings are located between the first and a second plate. When the jack arm stabilizer is placed within the jack arm stabilizer guide, the first set of bearings are positioned within the race located within the first arm of the jack arm stabilizer guide.

The jack arm stabilizer also comprises a second set of bearings located between the first and the second plate. As above, when the jack arm stabilizer is placed within the jack arm stabilizer guide, the second set of bearings are positioned within the race located within the second arm of the jack arm stabilizer guide.

In the preferred embodiment, the jack arm stabilizer guide is offset from the platform, relative to a perpendicular therefrom, at a first predetermined angle. This offset provides maximum clearance for jack arm by allowing the jack arm to engage more of the automobile to be lifted.

Additionally, the jack arm stabilizer is also offset from the jack arm, relative to a perpendicular therefrom, at a second predetermined angle proportional to the first predetermined angle.

The vertical lift system preferably comprises a bellow connected between the platform and the jack arm, wherein the bellow is capable of being inflated causing it to vertically expand, thereby lifting the jack arm and translocating the jack arm stabilizer between the first and the second terminal ends of the jack arm stabilizer guide.

The vertical lift system also comprises a portage system capable of delivering pneumatic fluid to the bellow so as to cause it to inflate. In the preferred embodiment, the pneumatic fluid comprises compressed air.

The bellow of the vertical lift system preferably comprises a bladder having a first and a second terminal end, a first retainer operatively attaching the first terminal end of the bladder to the jack arm, and a second retainer operatively attaching the second terminal end of the bladder to the platform.

The jack preferably further comprises a lock system to prevent the jack arm from descending subsequent to the jack arm having been lifted by the vertical lift system.

In the preferred embodiment, the lock system comprises a first and a second series of notches located in the first and second arm, respectively, of the jack arm stabilizer guide, a first pawl pivotally located between the first and the second plate of the jack arm stabilizer, the first pawl having an ear which is capable of ratcheting against the first series of notches located in the first arm of the jack arm stabilizer guide, and a second pawl pivotally located between the first and the second plate of the jack arm stabilizer, the second pawl having an ear which is capable of ratcheting against the second series of notches located in the second arm of the jack arm stabilizer guide.

When the vertical lift system stops lifting the jack arm, halting the progression of the jack arm stabilizer and thus the pawls, or should a system failure cause the compressed air to leak from any part of the vertical lift system, the pawls will drop down to the nearest notch, thereby securely bearing the weight of the load. Thus, the pawls and notches are a safety lock by preventing the unplanned descent of the jack arm.

In order for the jack arm to descend, it is necessary to pivot the pawls such they clear the notches. Therefore, the jack also preferably comprises a release system to release the lock system, thereby allowing the jack arm to descend subsequent to the jack arm having been lifted by the vertical lift system.

The release system comprises a device which, when activated, causes the ears of the first and second pawls to disengage from the first and second series of notches located in the first and second arms, respectively, of the jack arm stabilizer guide.

Thus, the release system allows the pawls to clear the notches upon the descent of the jack arm via exhausting compressed air from the bellow.

It should be noted that the pawls ratchet independently of each other. Thus, the jack arm is able to tilt, relative to horizontal. This feature finds particular utility in the lifting of an automobile near one of its wheels, since the automobile will tend to tilt as a result of having one of its wheels lifted off the ground while the other one remains thereon.

DESCRIPTION OF THE PREFERRED EMBODIMENT(S)

Figure 1:
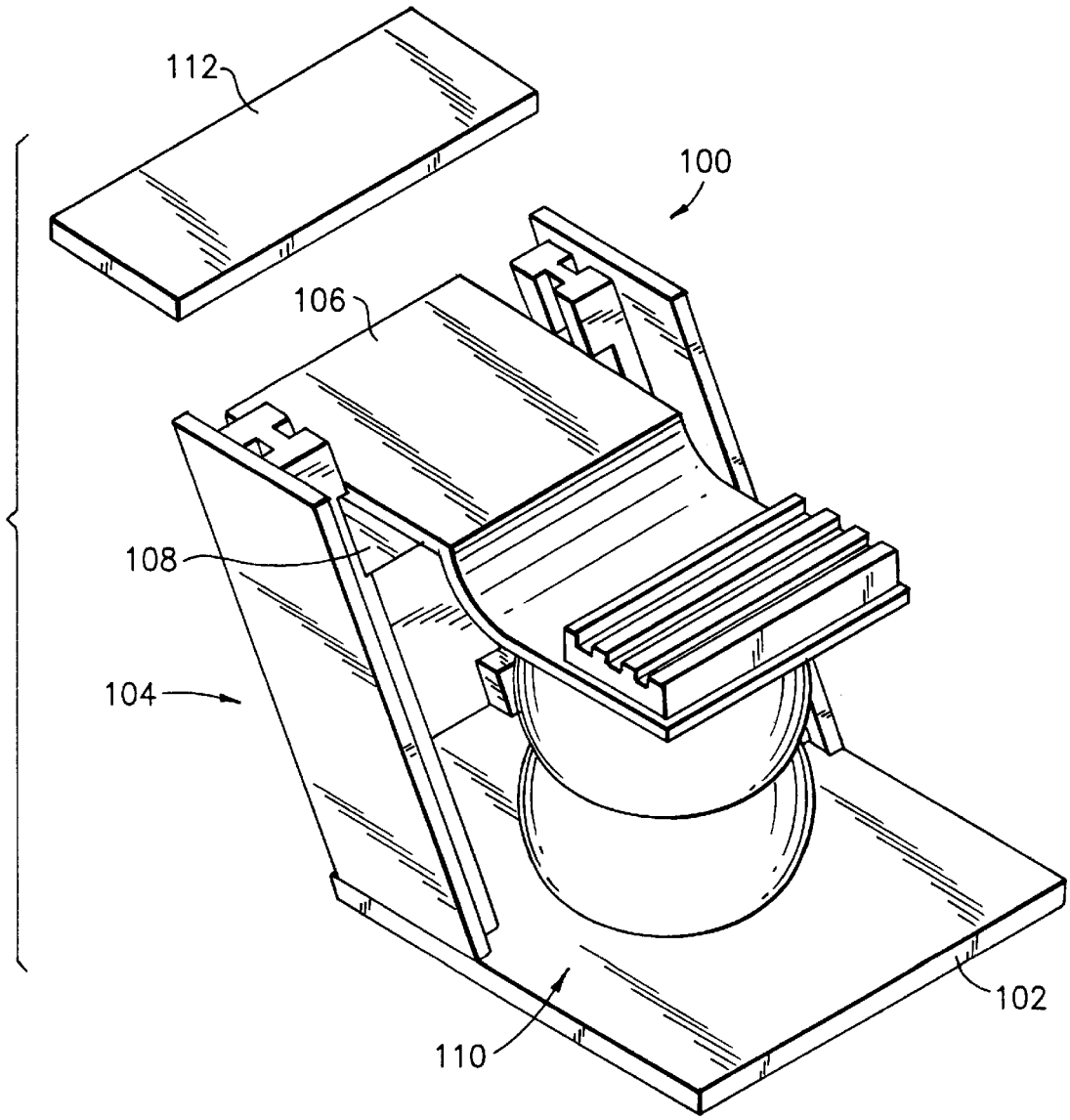
FIG. 1 illustrates an isometric view of the preferred embodiment of the present invention.

Turning now to FIG. 1, an isometric view of the preferred embodiment of the automotive jack of the present invention is shown. Specifically, jack 100 preferably comprises platform 102, jack arm stabilizer guide 104 attached to the platform, jack arm 106 translocatable within jack arm stabilizer guide 104 via jack arm stabilizer 108 attached thereto, and vertical lift system 110.

While the present invention is described with reference to the lifting of an automobile, it is to be understood that the present invention is not limited thereto.

In the preferred embodiment, plate 112 is secured to the top portion of jack arm stabilizer guide 104 to stabilize same, as well as to retain jack arm stabilizer 108 therewithin.

Figure 2:
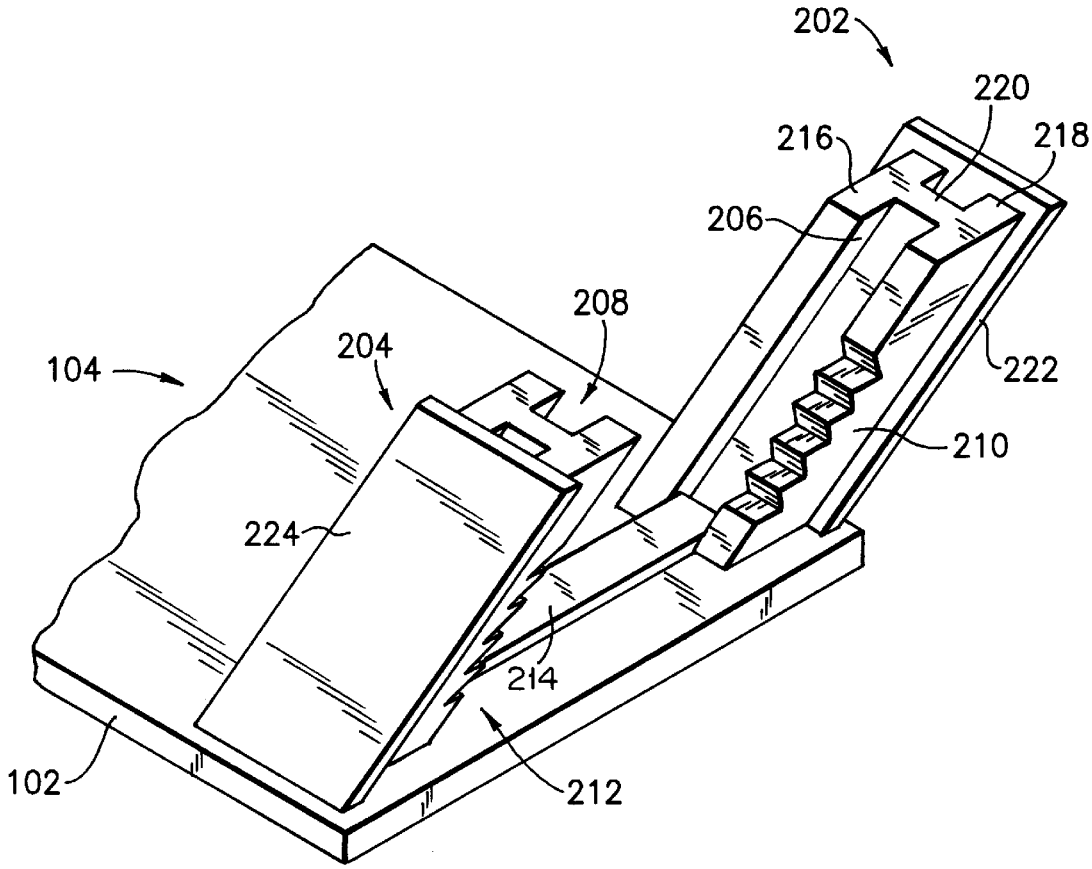
FIG. 2 depicts a partial isometric view of the preferred embodiment of the jack arm stabilizer guide shown in FIG. 1.

Turning now to FIG. 2, a partial isometric view of the preferred embodiment of jack arm stabilizer guide 104 is shown. Jack arm stabilizer guide 104 preferably comprises arm 202 diametrically opposed to arm 204, both rigidly attached to platform 102.

Arms 202 and 204 are preferably offset from platform 102, relative to a perpendicular therefrom, by a predetermined angle. In this way, as will be appreciated by those skilled in the art, maximum clearance is provided for jack arm (106, FIG. 1) by allowing the jack arm to engage more of the automobile to be lifted.

In the preferred embodiment, the predetermined angle is approximately 15 degrees, although other angles will be obvious to those skilled in the art.

Arms 202 and 204 preferably comprise race 206 and race 208, respectively, which serve as channels to slidably secure jack arm stabilizer 108 (FIG. 1) therewithin, as described below with reference to FIG. 3.

Arms 202 and 204 preferably also comprise notches 210 and 212, which serve as part of a safety lock and release system, described below with reference to FIG. 8.

Flat plate 214 is preferably located between the races to stabilize the relative positions thereof with respect to each other.

Arm 202 is comprised of sides 216 and 218, each preferably manufactured from 1.5 inch by 0.5 inch bar stock, separated by spacer 220 preferably manufactured from ⅝ inch square stock. Arm 204 is similarly constructed. Arms 202 and 204 are preferably housed via plates 222 and 224, respectively.

Figure 3:
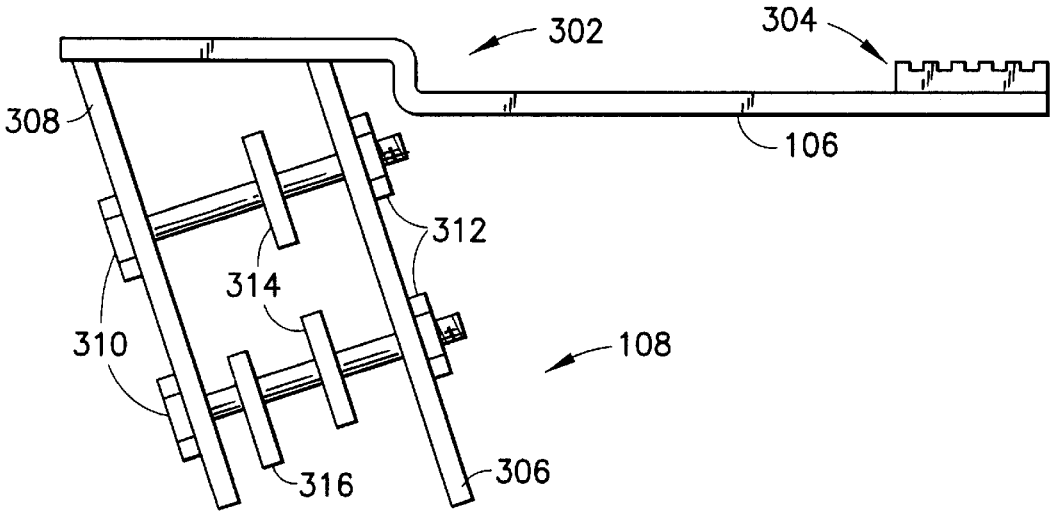
FIG. 3 shows a side view of the preferred embodiment of the jack arm and jack arm stabilizer shown in FIG. 1.

FIG. 3 shows a side view of the preferred embodiment of jack arm 106 and jack arm stabilizer 108.

Jack arm 106 is preferably curved as shown at reference 302, lowering the profile thereof to provide more clearance therefor. Optionally, rubber pad 304 is attached to the end of the jack arm to serve as a protector of the automobile being lifted.

Jack arm stabilizer 108 preferably comprises plates 306 and 308 securely attached to jack arm 106. Plates 306 and 308 are preferably offset from jack arm 106 at the same predetermined angle at which arms 202 and 204 (FIG. 2) are offset, thereby providing a relatively horizontal jack arm position.

Figure 4:
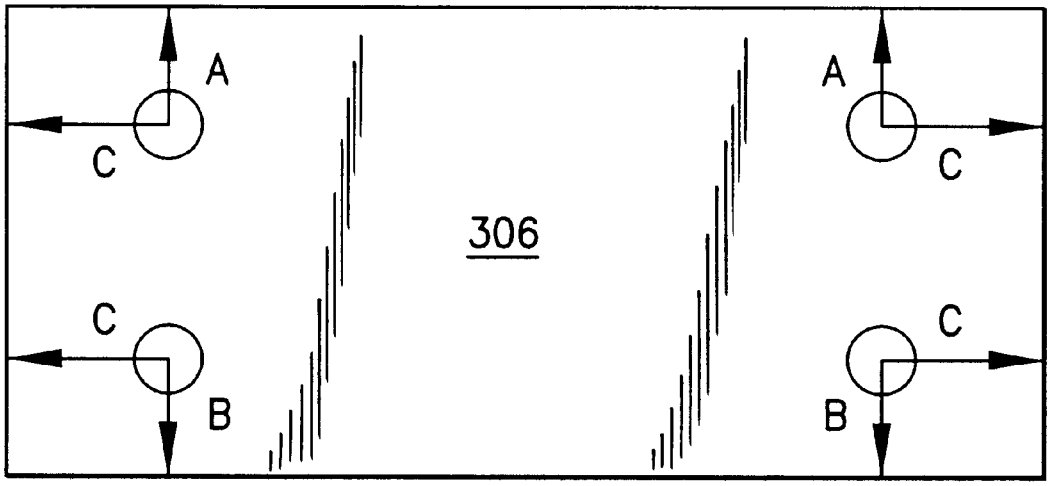
FIG. 4 illustrates a front view of the plate employed by the jack arm stabilizer shown in FIG. 3.

With reference to FIG. 4, a front view of the plates employed by jack arm stabilizer 108 (FIG. 3) is shown.

Plate 306 (308) preferably comprises four holes, located preferably as follows: dimension A is approximately 0.75 inches; dimension B is approximately 1.5 inches; and dimension C is approximately 1.5 inches. Plate 306 (Plate 308) is preferably comprised of ⅜ inch steel having nominal dimensions of 4 inches by 9 inches.

Returning now to FIG. 3, four bolts 310 are located through the four holes of plates 306 and 308, each bolt being secured by nuts 312. Attached to each shaft of the four nuts 312 are four roller bearings 314 which are freely rotatable thereabout. In the preferred embodiment, bearings 314 are Nice® bearings, manufactured by SKF USA, Inc. as part number 1633 DCTN.

It is to be noted that plate 306 is located in an inverse position, relative to plate 308. Given the preferred dimensions of the locations of the four holes in plates 306 and 308 (discussed above with reference to FIG. 4), the shafts of bolts 310 are positioned such that bearings 314 lie parallel to plates 306 and 308 (i.e., at the same predetermined angle at which arms 202 and 204 (FIG. 2) are offset).

Therefore, when jack arm stabilizer 108 is placed within jack arm stabilizer guide 104 (FIG. 1), bearings 314 will be positioned within races 206 and 208 of arms 202 and 204, respectively (FIG. 2). As plates 306 and 308 are preferably dimensioned to reside on the exterior of sides 216 and 218 (of arms 202 and 204, FIG. 2), respectively, ball bearings 314 reduce the friction therebetween.

Pawl 316 is preferably located on the shaft of each of the two bottom bolts. Pawls 316, in conjunction with notches 210 and 212 (on arms 202 and 204, FIG. 2), serve as part of a safety lock and release system, described below with reference to FIG. 8.

Figure 5:
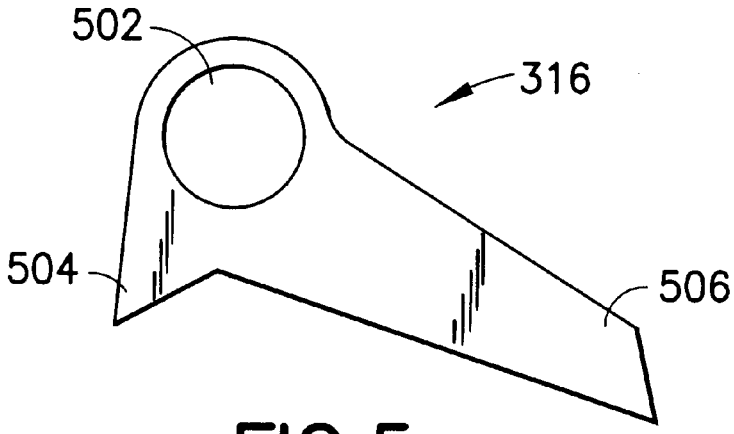
FIG. 5 is a front view of the preferred embodiment of the pawl employed by the jack arm stabilizer shown in FIG. 3.

With reference to FIG. 5, a front view of pawl 316 is shown, and includes void 502 for pivotal rotation about bolt 310 (FIG. 3), ear 504, and tail 506.

Figure 6:
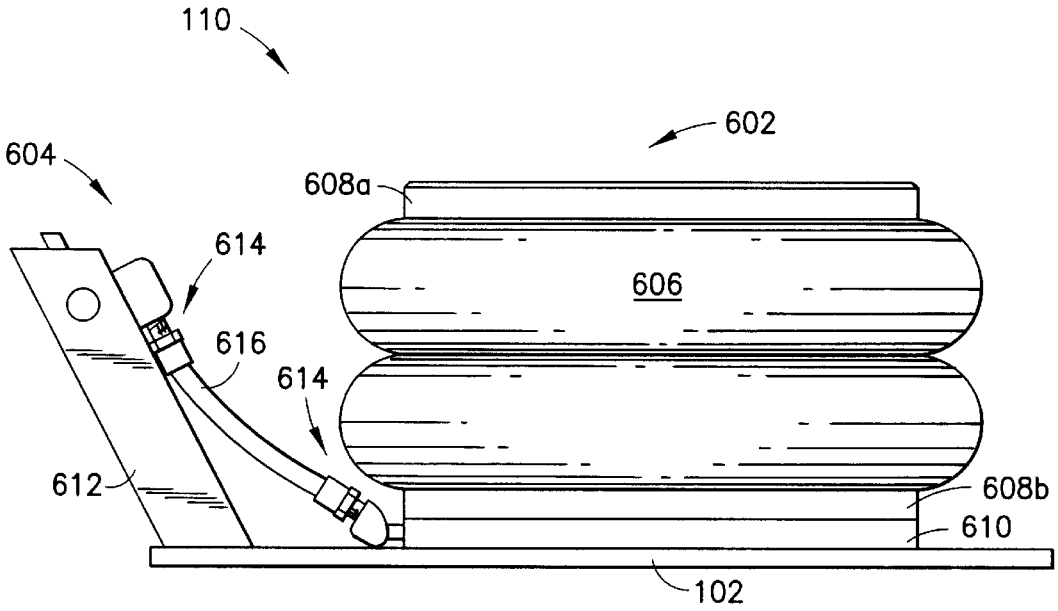
FIG. 6 illustrates a partial side view of the preferred embodiment of the vertical lift system shown in FIG. 1.

Turning now to FIG. 6, a partial view of vertical lift system 110 is shown. Vertical lift system 110 preferably comprises bellow 602 and portage system 604.

Bellow 602 preferably comprises bladder 606, bead rings 608 and retainer 610. Bladder 606 is preferably a two-tier rubber bladder which is capable of being inflated with a pneumatic fluid. In the preferred embodiment, the pneumatic fluid comprises compressed air, capable of being supplied to bellow 602 via portage system 604.

Bladder 606 comprises a lip at each terminal end over which bead rings 608 are placed. Bead ring **608*a* secures the upper portion of bladder 606 to the underside of jack arm 106 (FIG. 1) via a plurality of screws through a corresponding plurality of holes located therein (not shown). In the preferred embodiment, rubber gasket compound is employed therebetween to ensure the integrity of the seal. The lower portion of bladder 606 is preferably secured to platform 102 via bead ring 608*b* and retainer 610 by similar means. Bladder 606** is preferably approximately 10 inches in diameter, such as part number W01-358-7901 manufactured by Firestone.

Portage system 604 is capable of delivering compressed air to bellow 602 via valve housing unit 612, which delivers the compressed air thereto via couplings 614 and flexible tubing 616.

In the preferred embodiment, retainer 610 is employed between bead ring 608*b* and platform 102 to provide an inlet area for the compressed air to enter bladder 606. In the preferred embodiment, retainer 610 is identical to bead ring 608.

In the preferred embodiment, valve housing unit 612 is offset from platform 102 to correspond with the offset of jack arm stabilizer guide 104 (FIG. 1).

Figure 7:
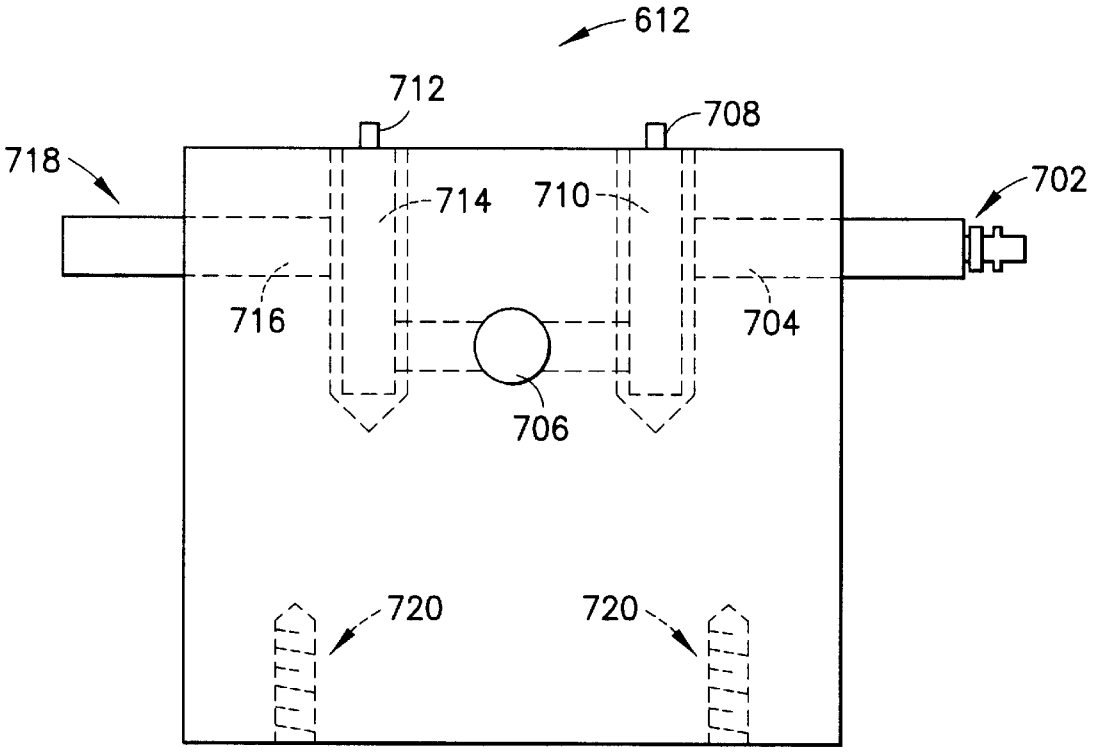
FIG. 7 depicts a front view of the preferred embodiment of the valve housing unit of the vertical lift system shown in FIG. 6.

With reference to FIG. 7, a front view of the preferred embodiment of valve housing unit 612 is shown, and includes compressed air inlet port 702 connected to inlet channel 704. A source of compressed air (not shown) is capable of being delivered to coupling 614 (FIG. 6) via outlet port 706 when plunger 708 of inlet valve 710 is depressed.

Similarly, when plunger 712 of exhaust valve 714 is depressed, compressed air within bladder 606 (FIG. 6) is vented via exhaust channel 716 to exhaust port 718. Valve housing unit 612 is preferably secured to platform 102 (FIG. 6) via threaded holes 720.

Returning to FIG. 6, portage system 604 preferably comprises a pressure regulating system (not shown) which bleeds off compressed air from inlet port 702 once a threshold pressure is reached within bladder 606.

Portage system 604 is available from The Unitec Manufacturing Corporation as part number ACV-107-R (with pressure regulator system) or ACV-107 (without pressure regulator system).

Figure 8:
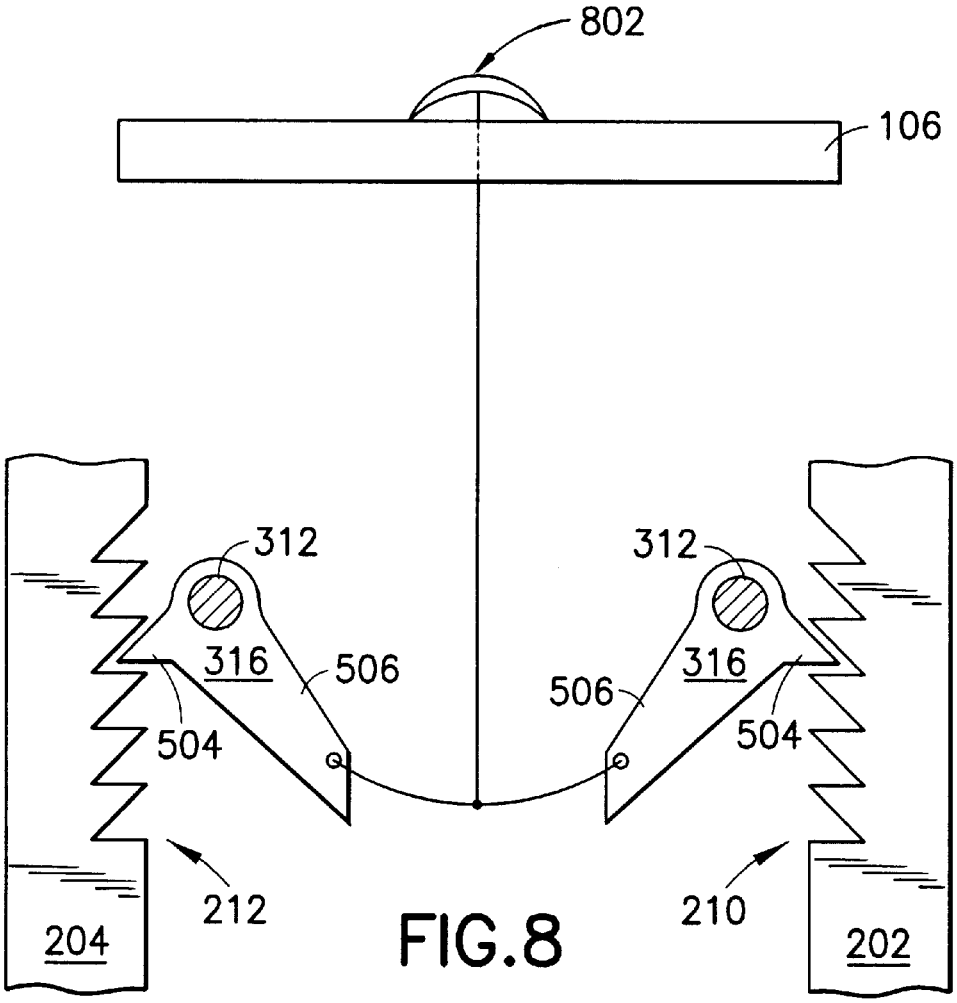
FIG. 8 illustrates the preferred embodiment of a lock and release system of the present invention.

Turning now to FIG. 8, the preferred embodiment of a lock and release safety system of the present invention is shown, and comprises pawls 316 acting in conjunction with notches 210 and 212 of arms 202 and 204, respectively, of the jack arm stabilizer guide (FIG. 2).

Pawls 316 are pivotable about the shafts of bolts 312, which are integral with the jack arm stabilizer, as discussed above. Thus, when the jack arm (and thus the jack arm stabilizer) is lifted by the vertical lift system, ears 504 of pawls 316 ratchet along notches 210 and 212 of arms 202 and 204, respectively, of the jack arm stabilizer guide (FIG. 2).

When the vertical lift system stops lifting the jack arm, halting the progression of the jack arm stabilizer and thus pawls 316, or should a system failure cause the compressed air to leak from any part of the vertical lift system (FIG. 6), ears 504 will drop down to the nearest notch, thereby securely bearing the weight of the load. Thus, the pawls and notches are a safety lock by preventing the unplanned descent of the jack arm.

It should be noted that pawls 316 ratchet independently of each other. Thus, the jack arm is able to tilt, relative to horizontal. This feature finds particular utility in the lifting of an automobile near one of its wheels, since the automobile will tend to tilt as a result of having one of its wheels lifted off the ground while the other one remains thereon.

In order for the jack arm to descend, it is necessary to pivot the pawls such that ears 504 clear notches 210 and 212. To do so, it may be necessary to slightly raise the jack arm.

Lifting safety handle 802 will cause ears 504 to rotate inward, thereby allowing same to clear notches 210 and 212 upon the descent of the jack arm via exhausting compressed air from the bellow (FIG. 6) as discussed above.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What I claim as my invention is:

1. A jack for lifting a load, said jack comprising:

a platform;

a jack arm stabilizer guide including a first arm having a first and a second terminal end, wherein the first terminal end of the first arm is attached to the platform, a race located within the first arm, a second arm having a first and a second terminal end, wherein the first terminal end of the second arm is attached to the platform, and a race located within the second arm, wherein the first arm and the second arm are attached to the platform such that the race located within the first arm is diametrically opposed to the race located within the second arm;

a jack arm stabilizer slidably interposed between the first arm and the second arm of the jack arm stabilizer guide and translocatable between the first and the second terminal ends thereof;

a jack arm having a first terminal end attached to the jack arm stabilizer and a second terminal end extending therefrom, wherein the load to be lifted is locatable on the jack arm; and a vertical lift system operatively connected between the jack arm and the platform, wherein the vertical lift system is capable of vertically lifting the jack arm, thus translocating the jack arm stabilizer between the first and the second terminal ends of the jack arm stabilizer guide.

2. The jack of claim 1, wherein the jack arm stabilizer comprises:

a first plate;

a second plate diametrically opposed to the first plate;

a first set of bearings rotatably located between the first and a second plate, wherein the first set of bearings are operatively positionable within the race located within the first arm of the jack arm stabilizer guide; and a second set of bearings rotatably located between the first and the second plate, wherein the second set of bearings are operatively positionable within the race located within the second arm of the jack arm stabilizer guide.

3. The jack of claim 1, wherein the jack arm stabilizer is offset from the jack arm, relative to a perpendicular therefrom, at a second predetermined angle proportional to the first predetermined angle.

4. The jack of claim 1, wherein the vertical lift system comprises:

a bellow operatively connected between the platform and the jack arm, wherein the bellow is capable of being inflated so as to cause the bellow to vertically expand, thereby lifting the jack arm and translocating the jack arm stabilizer between the first and the second terminal ends of the jack arm stabilizer guide; and a portage system capable of delivering pneumatic fluid to the bellow so as to cause the bellow to inflate.

5. The jack of claim 4, wherein the bellow of the vertical lift system comprises:

a bladder having a first and a second terminal end;

a first retainer operatively attaching the first terminal end of the bladder to the jack arm; and a second retainer operatively attaching the second terminal end of the bladder to the platform.

6. The jack of claim 1, the jack further comprising a lock system to prevent the jack arm from descending subsequent to the jack arm having been lifted by the vertical lift system.

7. The jack of claim 6, wherein the lock system comprises:

a first series of notches located in the first arm of the jack arm stabilizer guide;

a second series of notches located in the second arm of the jack arm stabilizer guide, wherein the first series of notches is diametrically opposed to the second series of notches;

a first pawl pivotally located between the first and the second plate of the jack arm stabilizer, the first pawl having an ear which is capable of ratcheting against the first series of notches located in the first arm of the jack arm stabilizer guide; and a second pawl pivotally located between the first and the second plate of the jack arm stabilizer, the second pawl having an ear which is capable of ratcheting against the second series of notches located in the second arm of the jack arm stabilizer guide.

8. The jack of claim 6, the jack further comprising a release system to release the lock system, thereby allowing the jack arm to descend subsequent to the jack arm having been lifted by the vertical lift system.

9. The jack of claim 7, wherein the first pawl is capable of ratcheting independently of the second pawl, thereby allowing the jack arm to tilt, relative to horizontal.

10. The jack of claim 7, the jack further comprising a releases system to release the lock system, thereby allowing the jack arm to descend subsequent to the jack arm having been lifted by the vertical lift system.

11. The jack of claim 10, wherein the release system comprises a device which, when activated, causes the ears of the first and second pawls to disengage from the first and second series of notches located in the first and second arms, respectively, of the jack arm stabilizer guide.

12. A jack for lifting a load, said jack comprising:

a platform;

a jack arm stabilizer guide including a first arm having a first and a second terminal end, wherein the first terminal end of the first arm is attached to the platform, a race located within the first arm, a second arm having a first and a second terminal end, wherein the first terminal end of the second arm is attached to the platform, and a race located within the second arm, wherein the first arm and the second arm are attached to the platform such that the race located within the first arm is diametrically opposed to the race located within the second arm;

a jack arm stabilizer slidably interposed between the first arm and the second arm of the jack arm stabilizer guide and translocatable between the first and the second terminal ends thereof;

a jack arm having a first terminal end attached to the jack arm stabilizer and a second terminal end extending therefrom, wherein the load to be lifted is locatable on the jack arm; and a bellow operatively connected between the platform and the jack arm, wherein the bellow is capable of being inflated so as to cause the bellow to vertically expand, thereby lifting the jack arm and translocating the jack arm stabilizer between the first and the second terminal ends of the jack arm stabilizer guide.

13. The jack of claim 12, wherein the bellow comprises:

a bladder having a first and a second terminal end;

a first retainer operatively attaching the first terminal end of the bladder to the jack arm; and a second retainer operatively attaching the second terminal end of the bladder to the platform.

14. The jack of claim 13, the jack further comprising a portage system capable of delivering pneumatic fluid to the bladder so as to cause the bladder to inflate.

15. The jack of claim 12, wherein the jack arm stabilizer comprises:

a first plate;

a second plate diametrically opposed to the first plate;

a first set of bearings rotatably located between the first and a second plate, wherein the first set of bearings are operatively positionable within the race located within the first arm of the jack arm stabilizer guide; and a second set of bearings rotatably located between the first and the second plate, wherein the second set of bearings are operatively positionable within the race located within the second arm of the jack arm stabilizer guide.

16. The jack of claim 12, the jack further comprising a lock system to prevent the jack arm from descending subsequent to the jack arm having been lifted by the vertical lift system.

17. The jack of claim 16, the jack further comprising a release system to release the lock system, thereby allowing the jack arm to descend subsequent to the jack arm having been lifted by the vertical lift system.

18. The jack of claim 16, wherein the lock system comprises:

a first series of notches located in the first arm of the jack arm stabilizer guide;

a second series of notches located in the second arm of the jack arm stabilizer guide, wherein the first series of notches is diametrically opposed to the second series of notches;

a first pawl pivotally located between the first and the second plate of the jack arm stabilizer, the first pawl having an ear which is capable of ratcheting against the first series of notches located in the first arm of the jack arm stabilizer guide; and a second pawl pivotally located between the first and the second plate of the jack arm stabilizer, the second pawl having an ear which is capable of ratcheting against the second series of notches located in the second arm of the jack arm stabilizer guide.

19. The jack of claim 18, wherein the first pawl is capable of ratcheting independently of the second pawl, thereby allowing the jack arm to tilt, relative to horizontal.

20. A jack for lifting a load, said jack comprising:

a platform;

a jack arm stabilizer guide including a first arm having a first and a second terminal end, wherein the first terminal end of the first arm is attached to the platform, a race located within the first arm, a second arm having a first and a second terminal end, wherein the first terminal end of the second arm is attached to the platform, and a race located within the second arm, wherein the first arm and the second arm are attached to the platform such that the race located within the first arm is diametrically opposed to the race located within the second arm;

a jack arm stabilizer slidably interposed between the first arm and the second arm of the jack arm stabilizer guide and translocatable between the first and the second terminal ends thereof;

a jack arm having a first terminal end attached to the jack arm stabilizer and a second terminal end extending therefrom, wherein the load to be lifted is locatable on the jack arm;

a bellow operatively connected between the platform and the jack arm, wherein the bellow is capable of being inflated by pneumatic fluid so as to cause the bellow to vertically expand, thereby lifting the jack arm and translocating the jack arm stabilizer between the first and the second terminal ends of the jack arm stabilizer guide; and a portage system capable of delivering the pneumatic fluid to the bellow so as to cause the bellow to inflate.

21. The jack of claim 20, wherein the bellow comprises:

a bladder having a first and a second terminal end;

a first retainer operatively attaching the first terminal end of the bladder to the jack arm; and a second retainer operatively attaching the second terminal end of the bladder to the platform.

22. The jack of claim 20, wherein the pneumatic fluid comprises compressed air.

23. The jack of claim 20, wherein the jack arm stabilizer comprises:

a first plate;

a second plate diametrically opposed to the first plate;

a first set of bearings rotatably located between the first and a second plate, wherein the first set of bearings are operatively positionable within the race located within the first arm of the jack arm stabilizer guide; and a second set of bearings rotatably located between the first and the second plate, wherein the second set of bearings are operatively positionable within the race located within the second arm of the jack arm stabilizer guide.

24. The jack of claim 23, the jack further comprising a lock system to prevent the jack arm from descending subsequent to the jack arm having been lifted by the vertical lift system.

25. The jack of claim 24, wherein the lock system comprises:

a first series of notches located in the first arm of the jack arm stabilizer guide;

a second series of notches located in the second arm of the jack arm stabilizer guide, wherein the first series of notches is diametrically opposed to the second series of notches;

a first pawl pivotally located between the first and the second plate of the jack arm stabilizer, the first pawl having an ear which is capable of ratcheting against the first series of notches located in the first arm of the jack arm stabilizer guide; and a second pawl pivotally located between the first and the second plate of the jack arm stabilizer, the second pawl having an ear which is capable of ratcheting against the second series of notches located in the second arm of the jack arm stabilizer guide.

26. The jack of claim 25, wherein the first pawl is capable of ratcheting independently of the second pawl, thereby allowing the jack arm to tilt, relative to horizontal.

27. The jack of claim 24, the jack further comprising a release system to release the lock system, thereby allowing the jack arm to descend subsequent to the jack arm having been lifted by the vertical lift system.

28. The jack of claim 1, wherein the race located within the first arm of the jack arm stabilizer guide and the race located within the second arm of the jack arm stabilizer guide are offset from the platform, relative to a perpendicular therefrom, at a first predetermined angle.

29. The jack of claim 12, wherein the race located within the first arm of the jack arm stabilizer guide and the race located within the second arm of the jack arm stabilizer guide are offset from the platform, relative to a perpendicular therefrom, at a first predetermined angle.

30. The jack of claim 29, wherein the jack arm stabilizer is offset from the jack arm, relative to a perpendicular therefrom, at a second predetermined angle proportional to the first predetermined angle.

31. The jack of claim 20, wherein the race located within the first arm of the jack arm stabilizer guide and the race located within the second arm of the jack arm stabilizer guide are offset from the platform, relative to a perpendicular therefrom, at a first predetermined angle.

32. The jack of claim 31, wherein the jack arm stabilizer is offset from the jack arm, relative to a perpendicular therefrom, at a second predetermined angle proportional to the first predetermined angle.

* * * * *